US006453910B1

(12) United States Patent
Lloyd

(10) Patent No.: US 6,453,910 B1
(45) Date of Patent: Sep. 24, 2002

(54) DEVICE FOR CREATING WAVE-STYLED HAIRDOS

(76) Inventor: Lisa Vitina Lloyd, 3335 N. Manor Dr., Tucson, AZ (US) 85750

( * ) Notice: Subject to any disclaimer, the term of this patent is extended or adjusted under 35 U.S.C. 154(b) by 0 days.

(21) Appl. No.: 09/816,198

(22) Filed: Mar. 26, 2001

(51) Int. Cl.[7] ..... A45D 2/12
(52) U.S. Cl. ..... 132/226
(58) Field of Search ..... 132/207, 210, 132/211, 226, 223, 233

(56) References Cited

U.S. PATENT DOCUMENTS

| | | | | | |
|---|---|---|---|---|---|
| 613,104 | A | * | 10/1898 | Zimmerman | 132/226 |
| 1,360,861 | A | * | 11/1920 | Alberghini | 132/226 |
| 1,386,134 | A | * | 8/1921 | Seyl | 132/226 |
| 1,638,443 | A | * | 8/1927 | Kadane et al. | 132/226 |
| 1,917,550 | A | * | 7/1933 | Saunders | 132/226 |
| 2,126,253 | A | * | 8/1938 | Goldberg | 132/226 |
| 2,491,939 | A | * | 12/1949 | Tasho | 132/233 |
| 3,889,097 | A | * | 6/1975 | Forsberg | 132/233 |
| 4,261,375 | A | * | 4/1981 | Anderson | 132/226 |
| 4,564,033 | A | * | 1/1986 | Kin | 132/233 |
| 4,753,251 | A | * | 6/1988 | Guerard et al. | 132/226 |
| 4,984,591 | A | * | 1/1991 | Jacobi | 132/226 |
| 4,993,441 | A | * | 2/1991 | Hanson | 132/226 |
| 5,119,846 | A | * | 6/1992 | Tadrous et al. | 132/223 |
| 5,460,190 | A | * | 10/1995 | Bondick | 132/233 |
| 5,749,379 | A | * | 5/1998 | Stillwagon | 132/233 |

* cited by examiner

*Primary Examiner*—Todd E. Manahan
(74) *Attorney, Agent, or Firm*—Michael S. Neustel

(57) ABSTRACT

The invention is a hair-wave device, and a method for creating wave-style hairdos. The hair-wave device generally includes a support structure that is capable of supporting a number of styling tools. The styling tools are typically located generally parallel with each other (such that they may appear to be side by side or one below the other). Typically, the support structure is a semi rigid body that has an environmentally resilient coat. The styling tools are typically made of an air permeable material such as foam, or a mesh, and are generally cylindrical in shape. The method for creating a wave styled hairdo generally includes the acts of wetting hair, weaving the wetted hair through a hair-wave device, and then allowing the hair to dry or either drying the hair.

18 Claims, 2 Drawing Sheets

Fig. 1
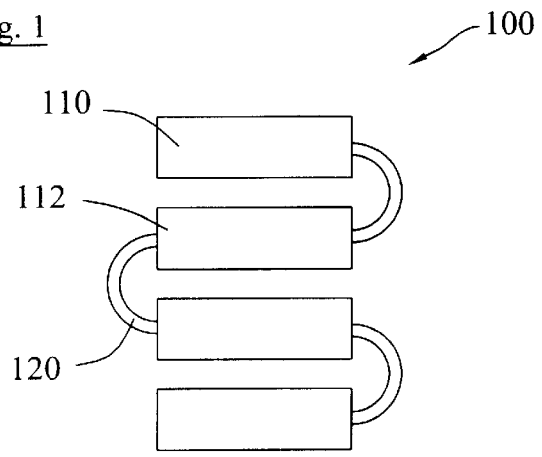
Fig. 2
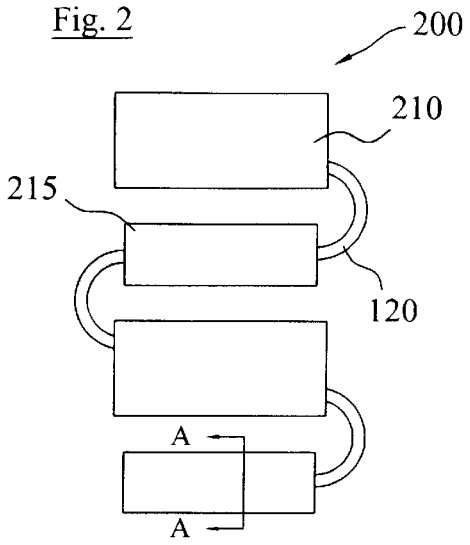
Fig. 3
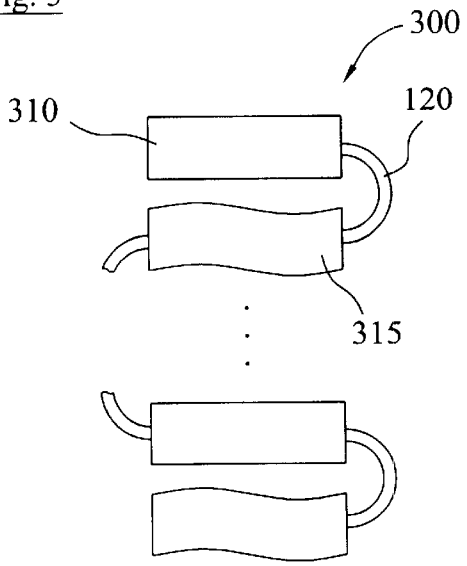
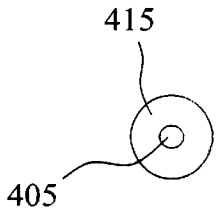
Fig. 4a
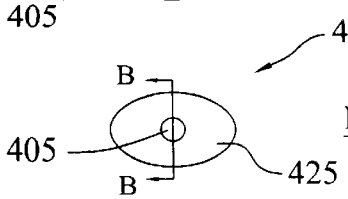
Fig. 4b
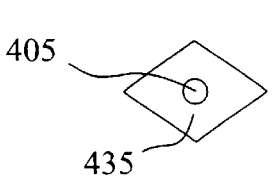
Fig. 4c
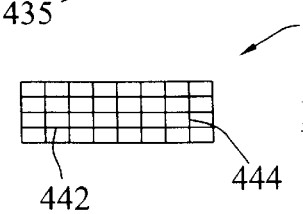
Fig. 4d

DEVICE FOR CREATING WAVE-STYLED HAIRDOS

TECHNICAL FIELD OF THE INVENTION

The invention relates generally to hair curlers and methods for creating a hairdo, and or particularly, the invention relates to devices and methods for creating wave-styled hairdos.

PROBLEM STATEMENT

Hairstyles have long been associated with defining individuality and expressing personality. Accordingly, many people go to great lengths of time and expense to create the "perfect" hairdo. To achieve the perfect hairdo individuals employ a number of hair styling devices and hair styling techniques.

One popular hairstyle is a waved hairstyle, which is well known in the hair styling arts. To achieve a waved hairdo, one must wrap hair and curl it around a curler, typically from the bottom of the hair to the scalp. Accordingly, for particularly long hair, the hair that is wrapped around the curler first is packed closest to the curler and surrounded by hair that is closer to the scalp. Unfortunately, when wrapped in this manner, as the hair dries, the bottom portion of the hair remains wet longer than the hair closest to the scalp. Accordingly, if a hair dryer is used to dry the hair, the hair closest to the scalp dries out, splits, "frizzies", and is otherwise damaged before the bottom portion of the hair can dry. This is even a problem when hair is not left under a dryer. Furthermore, wrapping hair around a single curler and rolling the curler toward the scalp creates a spiral curl rather than a wave. The spiral curl is particularly difficult to hold in place. Accordingly, it would be advantageous to have devices and methods for creating waved-style hairdos that promote fast drying, allow flexibility in styling decisions, and are easier to hold in place. The invention provides such devices and methods as defined in the claims.

SUMMARY OF THE INVENTION

The invention provides technical advantages as a hair-wave device, and as a method for creating a wave-style hairdo. The hair-wave device generally includes a support structure that is capable of supporting a number of styling tools. The styling tools are typically located generally parallel with each other (such that they may appear to be side by side or one below the other). Typically, the support structure is a semi rigid body that has an environmentally resilient coat, and will typically take on an S-shape, a ladder-shape, or a tooth-shape. The styling tools are typically made of an air permeable material such as foam, or a mesh, and are generally cylindrical in shape. Although generally cylindrical, each styling tool may have a circular, oval, polygonal, or other cross sectional shape. In addition, depending on the type of hairdo desired, styling tools of different shapes and sizes may be placed on a single support structure.

In another embodiment the invention is a method for creating a wave styled hairdo. The method generally includes the acts of wetting hair, weaving the wetted hair through a hair-wave device, and then allowing the hair to dry or either drying the hair. Of course, it should be understood that other embodiments of the invention will be readily apparent to those of ordinary skill in the art, and that similar results achieved by the invention may be achieved in a not dissimilar manner. Accordingly, the scope of the invention is limited only by the claims.

BRIEF DESCRIPTION OF THE DRAWING SECTION

Features of the invention will be apparent to those skilled in the art from the following detailed description of the invention, which should be read in conjunction with the accompanying drawings, in which:

FIG. 1 illustrates an embodiment of a hair-wave device;

FIG. 2 shows an alternative embodiment of a hair-wave device;

FIG. 3 is yet another alternative embodiment of a hair-wave device;

Figure 5A:
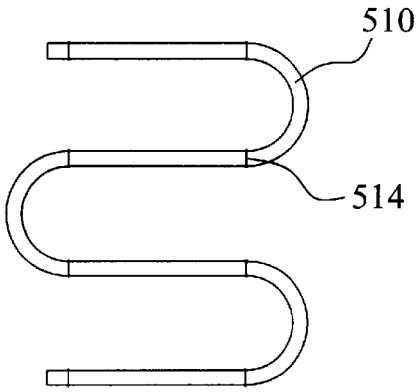
Figure 5B:
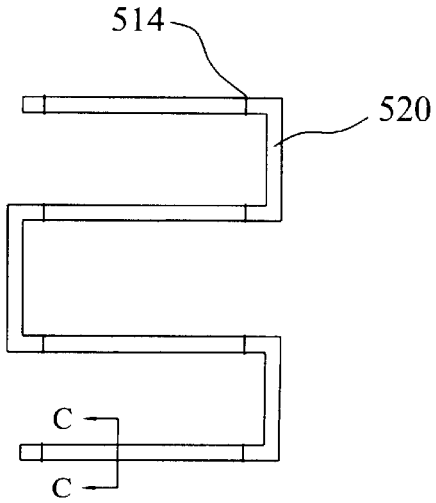
Figure 5C:
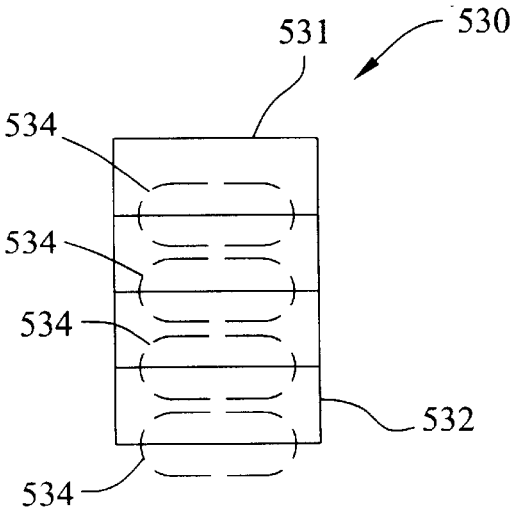
Figure 6:
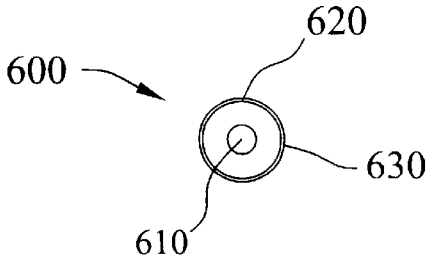

FIGS. 4*a–d* provide a number of exemplary styling tool cross sections, the cross sections taken across the cut AA of FIG. 2;

FIGS. 5*a–c* illustrate several exemplary embodiments of support structures; and FIG. 6 provides a cross-sectional view of a support structure taken along cut line CC of FIG. 5.

DETAILED DESCRIPTION OF THE INVENTION

The invention provides hair-wave devices, and methods for creating wave style hairdos. The hair-wave devices generally include a support structure that is capable of supporting a number of styling tools. The method of creating a wave styled hairdo generally includes the acts of wetting hair, weaving the wetted hair through a hair-wave device, and then allowing the hair to dry or either drying the hair. Accordingly, the invention provides advantages by allowing a user to make a wave-styled hairdo for practically any length of hair. A further advantage of the invention is that hair dries more uniformly, it dries in less time, and has fewer split ends, frizzies, and other damage. Yet another advantage of the invention is that a waved hairdo may be made more quickly since the invention allows hair to be spread over a larger area, and thus more quickly dried—this means that a higher-quality waved hairdo may be created more quickly, thus increasing customer satisfaction and providing a hair stylist the ability to do more styles in less time, thereby increasing revenues.

FIG. 1 illustrates an embodiment of a hair-wave device 100. In general, the hair-wave device 100 includes a support structure 120 having disposed thereon at least a first styling tool 110, and a second styling tool 112. The styling tools 110, 112 are typically located generally parallel with each other (such that they may appear to be side by side or one below the other). The support structure 120 is preferably a semi-rigid body that has an environmentally resilient coat, and will typically takes on an S-shape, a ladder-shape, or a tooth-shape. However, it should be understood that a semi-rigid (shape-returning) support structure is merely preferred, and that any support structure, such as a flimsy support structure, that is capable of supporting styling tools is incorporated within the scope of the invention.

The styling tools are typically made of an air-permeable material such as foam, or a mesh, and are generally cylindrical in shape. Although generally cylindrical, each styling tool may have a circular, an oval, a polygonal, or another cross-sectional shape. In addition, depending on the type of hairdo desired, styling tools of different shapes and sizes may be placed on a single support structure.

FIG. 2 shows an alternative embodiment of a hair-wave device 200. The hair-wave device 200 shown in FIG. 2 has a first styling tool 210 that is of a different size than the second styling tool 215. In addition, the first styling tool 210 and the second styling tool 215 may have different sizes, shapes, or cross-sections. Cross sectional cut AA is illustrated in further detail later in FIG. 4.

FIG. 3 provides yet another alternative embodiment of a hair-wave device 300. The hair-wave device 300 of FIG. 3 has a first styling tool 310, and a second styling tool 315. The second styling tool 315 is generally a waved-cylinder, instead of the generally cylindrical shaped first styling tool 310. Accordingly, it should be understood that the styling tool need only be elongated and capable of supporting hair in a waved fashion. In addition, the dotted lines of FIG. 3 are provided to illustrate that a hair-wave device may have any number of styling tools attached to it. For example, some embodiments of a hair-wave device may have two, three, four, or even ten or more styling tools.

FIGS. 4*a–d* illustrate a number of styling tool cross sections, the cross sections being taken across the cut-line AA of FIG. 2. A first styling tool 410 is illustrated as having a generally circular cross sectional hole 405 extending the length of the first styling tool 410. Each styling tool preferably has an analogous hole. Similarly, a second styling tool 420 is illustrated as having a generally oval cross sectional area 425, and a third styling tool 430 is illustrated has having a polygonal cross sectional area 435.

Of course, its should be understood that other cross sectional styles, such as star patterns, wagon-wheel styles, or other polygonal cross sections are possible and incorporated within the scope of the invention. A fourth styling tool 440 illustrates that cross sectional view taken of the second styling tool 420 across cut line BB thus, it can be seen that the second styling tool is made of a mesh-like structure that includes horizontal mesh pieces 442 and vertical mesh pieces 444. The fourth styling tool may be formed linking together the horizontal mesh structures 442 and the vertical mesh structures 444, or alternatively, the fourth styling tool may be formed from a single piece of molded plastic, although manner of manufacture is unimportant to the invention.

FIGS. 5*a–c* illustrate several exemplary embodiments of support structures. A first support structure 510 is illustrated having a general S-shaped. The support structure of 512 is shown has having a number of styling tool placement supports 514. The styling tool placement supports 514 may be formed directly on the support structure 510, or may be attached thereto. The styling tool placement supports 514 are preferably attached upon the support structure adjacent to each of the opposing ends of the styling tools.

A second support structure 520 has generally a tooth-shape. The tooth-shape could make it easier to provide styling tools of different sizes upon the second support structure 520. Furthermore, a third support structure 530 has a generally ladder-shape. The third support structure 530 is thus comprised of vertical members 532 and horizontal members 531. Preferably, each vertical member 531 is capable of supporting a styling tool 534, which are illustrated by dashed lines to emphasize the horizontal members 531 of the third support structure 530. Of course, the support structures illustrated in FIGS. 5*a–c* are exemplary support structures, and other types of support structures are encompassed within the scope and spirit of the invention.

FIG. 6 provides a cross sectional view of a support structure taken along the cut line CC of FIG. 5. FIG. 6 illustrates that a preferred embodiment of the support structure has a semi-rigid body 610, which could be made of metal, plastic, a coil, or other material that is capable of being bent and holding a shape then bent. In addition, the support structure preferably includes an environmentally resilient coat 620.

The environmentally resilient coat is designed to withstand high temperatures, wetness, and chemicals one expects hair to be exposed to when undergoing styling, coloring, or other hair treatments. Also, the support structure 600 is shown has having styling tool placement supports 630 attached to the environmentally resilient coat 620. Preferably, the styling tool placement supports 630 are also made of an environmentally resilient material. Also, the styling tool placement supports, 630 are designed to "give" when a styling tool is passed over them so that they will fit in a styling tool hole 405 and return to their original shape after the styling tool is passed over the styling tool placements supports. In this way, the styling tool placement supports hold the styling tools in place on a support structure. Of course, it should be understood that the way a styling tool is kept in place should not be interpreted as limiting, as there are many ways to keep a styling tool stationary relative to the support structure.

To re-iterate, the devices made according to the invention may be used to make a wave-styled hairdo. The preferred method for creating a wave styled hairdo generally includes the acts of wetting hair, weaving the wetted hair through a hair-wave device, and then allowing the hair to dry or either drying the hair. Furthermore, it should be understood that the above discussion is merely a description of an embodiment, and that the invention is limited only by the following claims.

I claim:

1. A hair-wave device for creating wave style hairdos, comprising:

an elongate support structure having a plurality of segments and a plurality of curved portions between said plurality of segments, wherein said elongate support structure has a first end and a second end, wherein said elongate support structure extends from said first end to said second end in an uninterrupted path; and a plurality of styling tools having a curler structure concentrically attachable respectively upon said plurality of segments, wherein said plurality of styling tools are each comprised of a cylindrical structure having an aperture extending longitudinally through thereof for receiving said plurality of segments.

2. The hair-wave device of claim 1, wherein said elongate support structure has a plurality of U-shaped portions between said plurality of segments.

3. The hair-wave device of claim 1, wherein said elongate support structure has a pair of vertical members attached to opposing ends of said plurality of segments.

4. The hair-wave device of claim 1, including a pair of placement supports attached to each of said plurality of segments for retaining said plurality of styling tools upon said plurality of segments.

5. The hair-wave device of claim 4, wherein said pair of placement supports are attached to said plurality of segments.

6. The hair-wave device of claim 4, wherein said pair of placement supports are non-movably attached to said plurality of segments.

7. The hair-wave device of claim 4, wherein said pair of placement supports are comprised of a resilient structure.

8. The hair-wave device of claim 4, wherein said pair of placement supports are attached upon each of said plurality of segments adjacent to opposing ends of said plurality of styling tools.

9. The hair-wave device of claim 1, wherein at least one of said plurality of styling tools is rotatably positioned upon said elongate support structure.

10. The hair-wave device of claim 1, wherein said plurality of styling tools are comprised of an air permeable material.

11. The hair-wave device of claim 10, wherein said plurality of styling tools are comprised of a foam material.

12. The hair-wave device of claim 10, wherein said plurality of styling tools are comprised of a mesh material.

13. The hair-wave device of claim 1, wherein said plurality of styling tools each have a circular cross sectional shape.

14. The hair-wave device of claim 1, wherein said plurality of styling tools each have an oval cross sectional shape.

15. The hair-wave device of claim 1, wherein at least one of said plurality of styling tools has a straight structure.

16. The hair-wave device of claim 1, wherein at least one of said plurality of styling tools has a curved structure.

17. The hair-wave device of claim 1, wherein said support structure is comprised of a semi-rigid body.

18. The hair-wave device of claim 1, wherein said support structure includes a resilient coating.

* * * * *